US005560067A

United States Patent [19]

Brook

[11] Patent Number: 5,560,067

[45] Date of Patent: Oct. 1, 1996

[54] JEWELRY CLEANING AND POLISHING DEVICE

[76] Inventor: Jason S. Brook, 3896 Haines St., San Diego, Calif. 92109

[21] Appl. No.: 543,402

[22] Filed: Oct. 16, 1995

[51] Int. Cl.[6] ..... A47L 13/12

[52] U.S. Cl. ..... 15/104.94; 15/118; 15/210.1

[58] Field of Search ..... 15/104.93, 104.94, 15/118, 208, 209.1, 210.1

[56] References Cited

U.S. PATENT DOCUMENTS

| | | | |
|---|---|---|---|
| 885,276 | 4/1908 | McDonald | 15/209.1 |
| 1,857,145 | 5/1932 | Funk | 15/210.1 |
| 3,611,469 | 10/1971 | Belli | 15/118 |
| 4,359,798 | 11/1982 | Loran | 15/104.94 |
| 4,575,891 | 3/1986 | Valente | 15/104.93 |
| 4,601,081 | 7/1986 | Sutton | 15/104.94 |
| 5,092,013 | 3/1992 | Genovese, Jr. | 15/104.94 |
| 5,176,754 | 1/1993 | Hirzel | 15/118 |
| 5,341,538 | 8/1994 | Banome | 15/209.1 |

*Primary Examiner*—David Scherbel
*Assistant Examiner*—Randall E. Chin
*Attorney, Agent, or Firm*—James & Franklin; Robert L. Epstein; Harold James

[57] ABSTRACT

The elongated, substantially flat base has a gripping portion and a second portion. The second portion of the base has first and second oppositely oriented surfaces. A first fabric section, treated with jewelers' rouge, is adhesively affixed to the first surface and used for cleaning. A second fabric section is adhesively affixed to the second surface and used for polishing. The fabric sections may be felt or cotton and are visually distinguishable for ready identification.

17 Claims, 2 Drawing Sheets

JEWELRY CLEANING AND POLISHING DEVICE

The present invention is the subject of a Disclosure Document No. 353,889 dated May 9, 1994 and of copending Design patent application Ser. No. 29/024,023, filed Jun. 6, 1994, pending.

The present invention relates to a device for cleaning and polishing jewelry and more particularly to such a device which is completely portable and combines both functions in a single, structurally simple, inexpensive and easy to use device.

Many different preparations and mechanisms are available on the market for cleaning and polishing jewelry. These range from chemical preparations and polishing cloths to electrically energized ultra-sonic devices of various types. However, the preparations may smell bad, be messy to use or be toxic. The devices tend to be expensive and bulky. Some of the preparations may not be safe to use on all materials. Further, conventional products are capable of performing only one function, requiring two or more to be used in combination to perform both cleaning and polishing.

It is, therefore, a prime object of my invention to provide a single, simple, inexpensive and completely portable device which performs both cleaning and polishing of jewelry.

It is another object of the present invention to provide a device which is capable of cleaning and polishing rings, watches, bracelets, neckleaces and other fine jewelry and which is safe for all precious metals including gold silver, platinum and brass.

It is another object of the present invention to provide a jewelry cleaning and polishing device which is reuseable and is capable of returning jewelry to its original luster and brilliance, without scratching.

In accordance with the present invention, a jewelry cleaning and polishing device is provided. The device includes an elongated, substantially flat base having a gripping portion and a second portion. The second portion of the base has first and second oppositely oriented surfaces. A cleaning fabric section, pretreated with a cleaning preparation such as jewelers' rouge, is affixed to the first surface of the base. A polishing fabric section is affixed to the second surface of the base.

The base may take the form of a board. The board may be composed of wood or plastic.

The cleaning fabric section may be composed of cotton or felt. The polishing fabric section may be composed of cotton or felt, as well.

A layer of adhesive is provided between the first surface and the cleaning fabric section to adhere same to the base. A layer of adhesive is provided between the second surface and the polishing fabric section to adhere same to the base.

The gripping portion comprises approximately one half of the base. The second portion also comprises approximately one half of the base.

The base is approximately seven inches long and one half inch wide. The second portion may be tapered.

The cleaning fabric section is preferrably a first color and the polishing fabric section is preferrably a second color. Thus, the cleaning fabric section and the polishing fabric are visually distinguishable so as to assist the user in choosing the sections for use in the correct order.

To these and to such other objects which may hereinafter appear, the present invention relates to a device for cleaning and polishing jewelry, as described in detail in the following specification and recited in the annexed claims, taken together with the accompanying drawings, wherein like numerals refer to like parts and in which:

Figure 1:
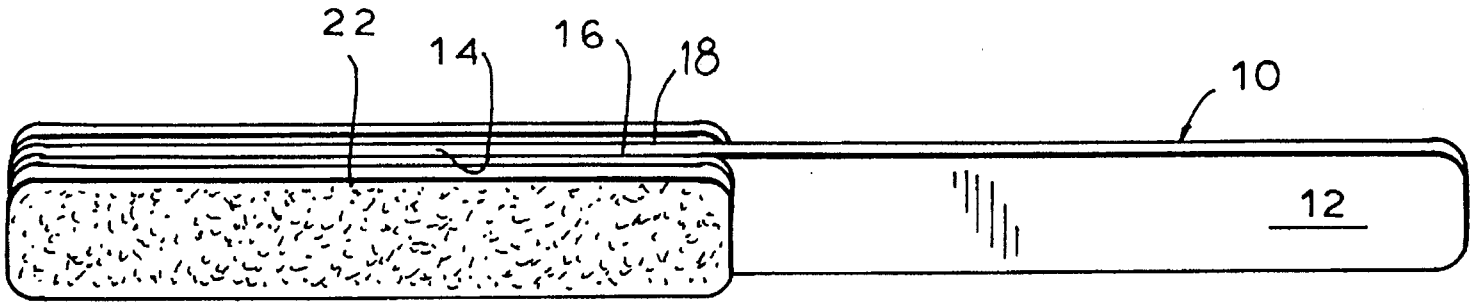
FIG. 1 is an isometric view showing one surface, one side and one end of the device.
Figure 2:
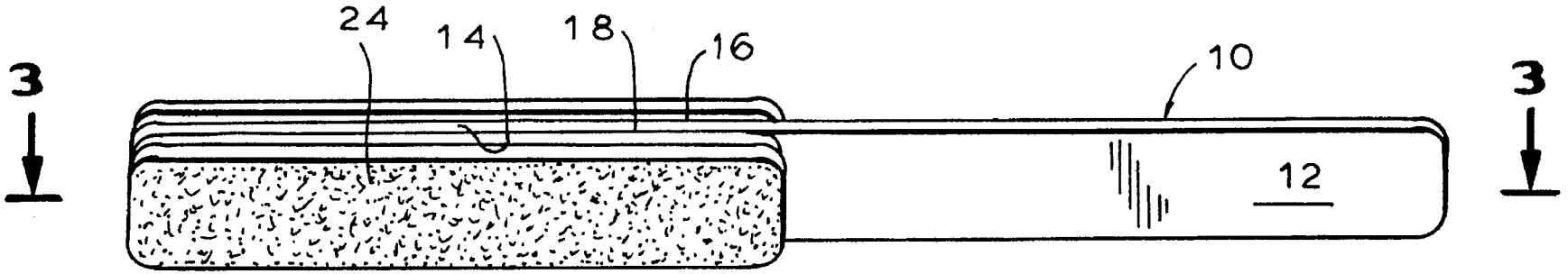
FIG. 2 is an isometric view showing the other surface, other side and other end of the device.
Figure 3:
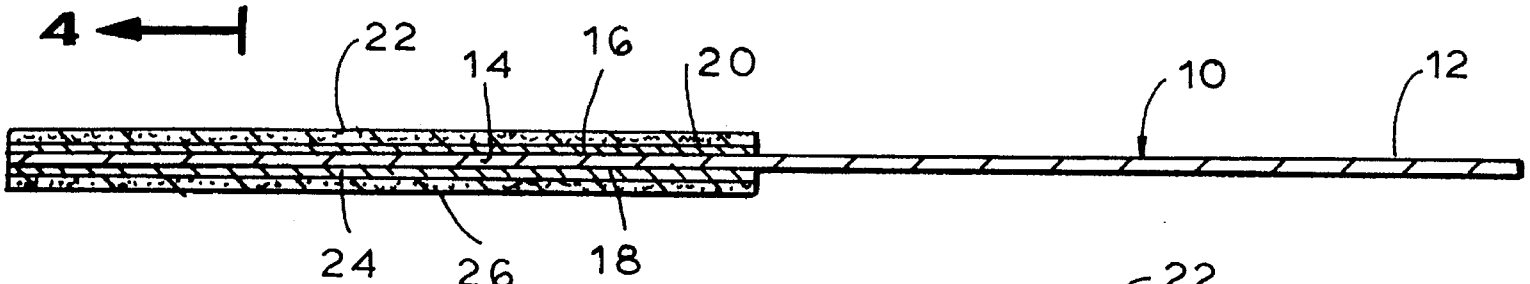
FIG. 3 is a side cross-sectional view of the device taken along line 3—3 of FIG. 2.
Figure 4:
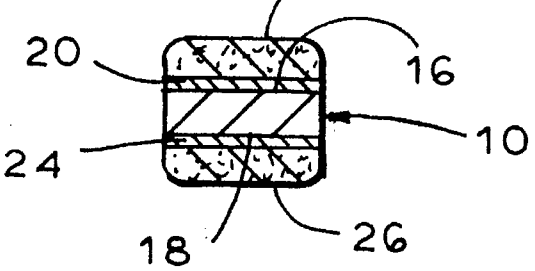
FIG. 4 is an enlarged cross-sectional view of the device taken along line 4—4 of FIG. 3.

As seen in the figures, the device of the present invention consists of a board-like base 10 approximately seven inches long and one half inch wide. Base 10 is relatively rigid and may be made of plastic or wood.

Base 10 has a gripping portion 12 which is approximately one half its length and a second portion 14 which takes up the remainder of the base. Portion 14 has a first surface 16 and a second surface 18 which are oppositely oriented.

Affixed to surface 16 by a layer 20 of adhesive is a section 22 of a cleaning fabric or cloth. Preferably, section 22 is composed of felt or cotton which has been pretreated with a cleaning preparation such as jewelers' rouge.

Affixed to surface 18 by a layer 24 of adhesive is a section 26 of polishing fabric or cloth. Section 26 is also composed of felt or cotton, but is untreated.

The base defines a longitudinal axis and the sections 22 and 26 define a width transverse the longitudinal axis and the gripping portion 12 also defines a width transverse to the longitudinal axis, the transverse width of the sections 22 and 26 being no greater than the transverse width of the gripping portion 12.

Figure 5:
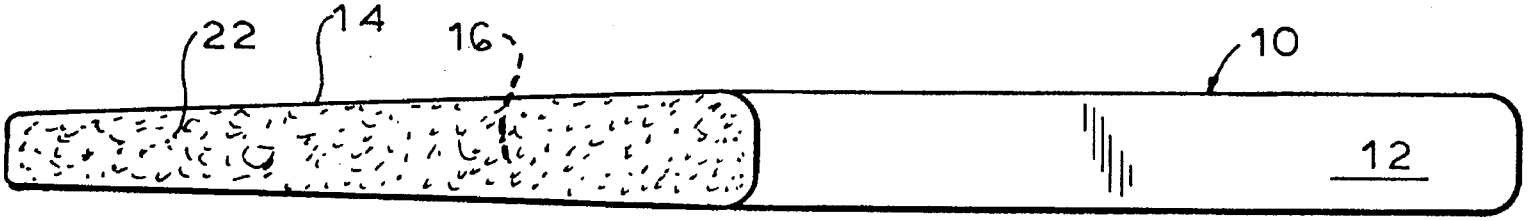
FIG. 5 is a front view of a tapered embodiment of the device.

In the embodiment of FIGS. 1–4, the second portion is untapered. In the embodiment of FIG. 5, the second portion is tapered so that it can more easily fit into smaller spaces.

Sections 22 and 26 are preferrably visually distinguishable. For example, they may be different colors or different shades of the same color.

In use, the device is gripped and manipulated like an emory board. The first step is to choose the cleaning section 22 and move the board relative to the jewelry piece with light strokes. After the cleaning operation is completed, the device is turned over and moved relative to the piece to produce a lustrous shine.

It should now be appreciated that the present invention is a wand-like jewelry cleaning and polishing device which is simple in structure and easy to use. It consists of a base with a section of treated cleaning fabric affixed to one side and a section of polishing fabric affixed to the other side. The device is suitable for use with many types of jewelry, made of various materials.

While only a limited number of preferred embodiments have been disclosed herein for purposes of illustration, it is obvious that many variations and modifications could be made thereto. It is intended to cover all of these variations and modifications which fall within the scope of the invention, as defined by the following claims:

I claim:

1. A jewelry cleaning and polishing device comprising an elongated substantially flat base defining a longitudinal axis and having a gripping portion and a second portion, said second portion comprising first and second oppositely oriented surfaces, a first fabric section, pretreated with cleaning preparation, affixed to and being substantially co-extensive with said first surface, for use in cleaning and a second fabric section, affixed to and being substantially co-extensive with said second surface, for use in polishing said first and second fabric sections defining a width transverse to said longitudinal axis and said gripping portion defining a width transverse to said longitudinal axis, said transverse width of said first and second fabric sections being no greater than said transverse width of said gripping portion.

2. The device of claim 1 wherein said cleaning preparation is jewelers' rouge.

3. The device of claim 1 wherein said base comprises a board.

4. The device of claim 3 wherein said board is composed of wood.

5. The device of claim 3 wherein said board is composed of plastic.

6. The device of claim 1 wherein said first fabric section is composed of cotton.

7. The device of claim 1 where said second fabric section is composed of cotton.

8. The device of claim 1 wherein said first fabric section is composed of felt.

9. The device of claim 1 wherein said second fabric section is composed of felt.

10. The device of claim 1 further comprising a layer of adhesive between said first surface and said first fabric section.

11. The device of claim 1 further comprising a layer of adhesive between said second surface and said second fabric section.

12. The device of claim 1 wherein said gripping portion comprises approximately one half the length of said base.

13. The device of claim 1 wherein said second portion comprises approximately one half the length of said base.

14. The device of claim 1 wherein said base is approximately seven inches long and one half inch wide.

15. The device of claim 1 wherein said first fabric section is a first color and said second fabric section is a second color.

16. The device of claim 1 wherein said first fabric section and said second fabric section are visually distinguishable.

17. The device of claim 1 wherein said second portion is tapered.

* * * * *